US005941623A

United States Patent [19]

Linehan

[11] Patent Number: 5,941,623

[45] Date of Patent: Aug. 24, 1999

[54] STORAGE SYSTEM FOR USE WITH REFRIGERATORS

[76] Inventor: Terrance G. Linehan, 8748 Rankin Ave., #B, St. Louis, Mo. 63144

[21] Appl. No.: 09/031,480

[22] Filed: Feb. 26, 1998

[51] Int. Cl.[6] ..... A47B 96/04

[52] U.S. Cl. ..... 312/404; 312/408; 312/280; 224/42.11; 211/88.01

[58] Field of Search ..... 312/408, 404, 312/280, 281, 205; 211/118, 117, 88.01, 86.01; 224/430, 429, 42.11, 905, 609, 646; 54/37.1, 44.1; 24/265 C, 265 R, 265 AL, 265 CD

[56] References Cited

U.S. PATENT DOCUMENTS

| | | | |
|---|---|---|---|
| D. 314,488 | 2/1991 | Aaldenberg et al. | 211/88.01 X |
| 340,339 | 4/1886 | Marshall | 224/42.11 X |
| 417,220 | 12/1889 | Bell | 224/905 X |
| 510,821 | 7/1893 | Browne | 224/42.11 X |
| 2,807,371 | 9/1957 | Johnson | 211/117 X |
| 3,717,188 | 2/1973 | Green | 224/42.11 X |
| 3,938,718 | 2/1976 | Madison | 24/265 AL X |
| 4,442,960 | 4/1984 | Vetter | 224/430 X |
| 4,687,094 | 8/1987 | Allsop et al. | 211/88.01 X |
| 4,955,516 | 9/1990 | Satterfield | 224/430 X |
| 5,125,612 | 6/1992 | McNeal . | |
| 5,341,941 | 8/1994 | Marlor | 211/26.1 |
| 5,581,829 | 12/1996 | Lee | 224/42.11 X |

FOREIGN PATENT DOCUMENTS

| | | | |
|---|---|---|---|
| 69365 | 1/1952 | Netherlands | 224/42.11 |

*Primary Examiner*—Peter M. Cuomo
*Assistant Examiner*—Hanh V. Tran

[57] ABSTRACT

A new storage system for use with refrigerators for storing a wide array of kitchen products to save space in the kitchen. The inventive device includes a pair of planar sections adapted for securement to opposing sides of a refrigerator. A strap system is adapted for adjustably securing the planar sections together for engaging the refrigerator. A plurality of containers are adapted for securement to the plurality of sections.

7 Claims, 2 Drawing Sheets

STORAGE SYSTEM FOR USE WITH REFRIGERATORS

BACKGROUND OF THE INVENTION

1. Field of the Invention

The present invention relates to shelving units and more particularly pertains to a new storage system for use with refrigerators for storing a wide array of kitchen products to save space in the kitchen.

2. Description of the Prior Art

The use of shelving units is known in the prior art. More specifically, shelving units heretofore devised and utilized are known to consist basically of familiar, expected and obvious structural configurations, notwithstanding the myriad of designs encompassed by the crowded prior art which have been developed for the fulfillment of countless objectives and requirements.

Known prior art shelving units include U.S. Pat. No. 5,397,087 to Teece; U.S. Pat. No. 4,753,495 to Swink; U.S. Pat. No. Des. 291,841 to Ownes; U.S. Pat. No. 5,339,546 to Rahwan; U.S. Pat. No. 5,351,813 to Golovan; and U.S. Pat. No. Des. 353,385 to Westendorf.

While these devices fulfill their respective, particular objectives and requirements, the aforementioned patents do not disclose a new storage system for use with refrigerators. The inventive device includes a pair of planar sections adapted for securement to opposing sides of a refrigerator. A strap system is adapted for adjustably securing the planar sections together for engaging the refrigerator. A plurality of containers are adapted for securement to the plurality of sections.

In these respects, the storage system for use with refrigerators according to the present invention substantially departs from the conventional concepts and designs of the prior art, and in so doing provides an apparatus primarily developed for the purpose of storing a wide array of kitchen products to save space in the kitchen.

SUMMARY OF THE INVENTION

In view of the foregoing disadvantages inherent in the known types of shelving units now present in the prior art, the present invention provides a new storage system for use with refrigerators construction wherein the same can be utilized for storing a wide array of kitchen products to save space in the kitchen.

The general purpose of the present invention, which will be described subsequently in greater detail, is to provide a new storage system for use with refrigerators apparatus and method which has many of the advantages of the shelving units mentioned heretofore and many novel features that result in a new storage system for use with refrigerators which is not anticipated, rendered obvious, suggested, or even implied by any of the prior art shelving units, either alone or in any combination thereof.

To attain this, the present invention generally comprises a pair of planar sections adapted for securement to opposing sides of a refrigerator. Each of the planar sections has an inwardly turned upper section. The inwardly turned upper section extends essentially perpendicular with respect to the planar section. The inwardly turned upper section extends on to a top wall of the refrigerator. Each of the planar sections has a plurality of linear rows of apertures therethrough disposed in a spaced relationship along an entire length and width thereof. A strap system is adapted for adjustably securing the planar sections together for engaging the refrigerator. The strap system comprises a pair of male straps and a pair of female straps. The pair of male straps extend outwardly from the inwardly turned upper section of a first section and the pair of female straps extend outwardly from the inwardly turned upper section of a second section. The male straps extend across the top wall of the refrigerator for adjustably coupling with the female straps. A plurality of large and small containers are adapted for securement to the plurality of sections. The containers each are defined by a closed forward face and an open rearward face. The open rearward face has a plurality of protrusions extending outwardly therefrom. The plurality of protrusions removably couple with the apertures of the planar sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage system for use with refrigerators apparatus and method which has many of the advantages of the shelving units mentioned heretofore and many novel features that result in a new storage system for use with refrigerators which is not anticipated, rendered obvious, suggested, or even implied by any of the prior art shelving units, either alone or in any combination thereof.

It is another object of the present invention to provide a new storage system for use with refrigerators which may be easily and efficiently manufactured and marketed.

It is a further object of the present invention to provide a new storage system for use with refrigerators which is of a durable and reliable construction.

An even further object of the present invention is to provide a new storage system for use with refrigerators which is susceptible of a low cost of manufacture with regard to both materials and labor, and which accordingly is then susceptible of low prices of sale to the consuming public, thereby making such storage system for use with refrigerators economically available to the buying public.

Still yet another object of the present invention is to provide a new storage system for use with refrigerators which provides in the apparatuses and methods of the prior art some of the advantages thereof, while simultaneously overcoming some of the disadvantages normally associated therewith.

Still another object of the present invention is to provide a new storage system for use with refrigerators for storing a wide array of kitchen products to save space in the kitchen.

Yet another object of the present invention is to provide a new storage system for use with refrigerators which includes a pair of planar sections adapted for securement to opposing sides of a refrigerator. A strap system is adapted for adjustably securing the planar sections together for engaging the refrigerator. A plurality of containers are adapted for securement to the plurality of sections.

Still yet another object of the present invention is to provide a new storage system for use with refrigerators that provides greater space and organization in any kitchen.

Even still another object of the present invention is to provide a new storage system for use with refrigerators that is adjustable to fit all sizes of refrigerators.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such descriPtion makes reference to the annexed drawings wherein.

DESCRIPTION OF THE PREFERRED EMBODIMENT

Figure 1:
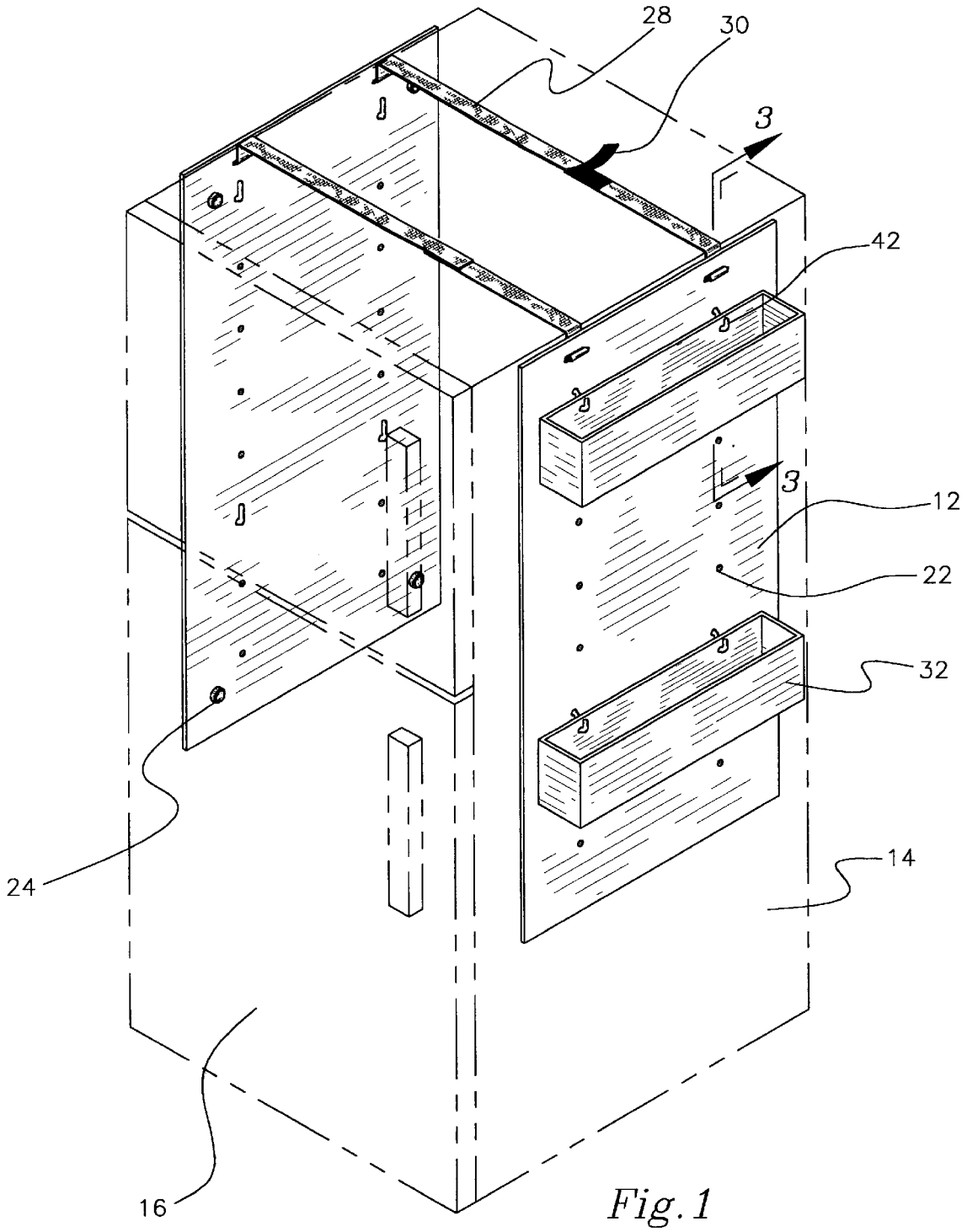
FIG. 1 is a perspective view of a new storage system for use with refrigerators according to the present invention.
Figure 2:
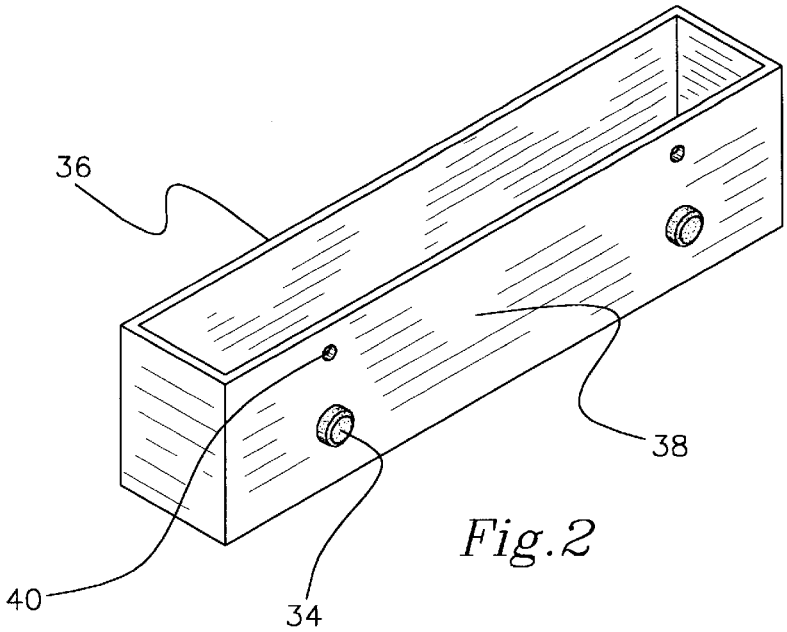
FIG. 2 is a rear perspective view of the container of the present invention.
Figure 3:
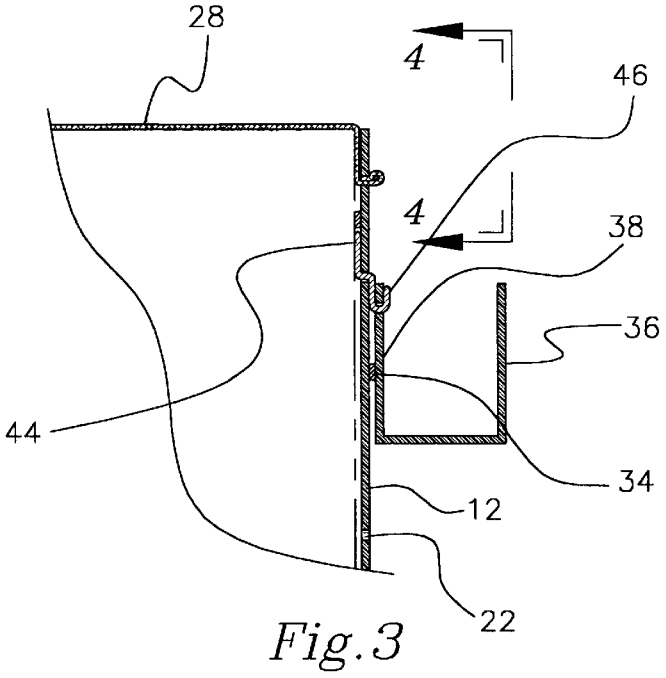
FIG. 3 is a cross-sectional view of the present invention as taken along line 3—3 of FIG. 1.
Figure 4:
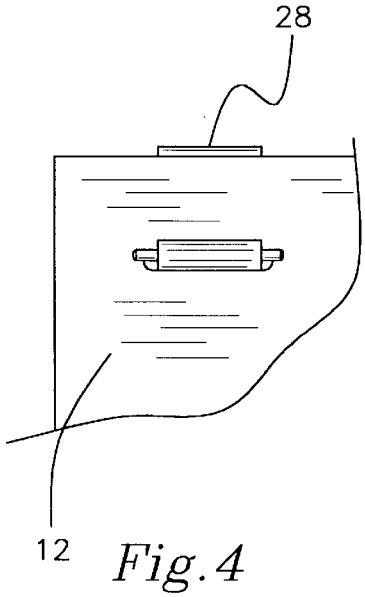
FIG. 4 is a front view of the present invention as taken along line 4—4 of FIG. 3.

With reference now to the drawings, and in particular to FIGS. 1 through 4 thereof, a new storage system for use with refrigerators embodying the principles and concepts of the present invention and generally designated by the reference numeral 10 will be described.

As best illustrated in FIGS. 1 through 4, the storage system for use with refrigerators 10 comprises a pair of planar sections 12 adapted for securement to opposing sides 14 of a refrigerator 16. Each of the planar sections 12 has a pair of linear rows of apertures 22 therethrough disposed in a spaced relationship along an entire length thereof. Rear surfaces of the planar sections 12 each have spacers 24 disposed thereon.

A strap system is adapted for adjustably securing the planar sections 12 together for engaging the refrigerator 16. The strap system comprises a pair of straps 28 extending outwardly from upper ends of the planar sections 12. Each of the straps have hook and loop patches 30 disposed on free ends thereof. The straps extend across a top wall of a refrigerator for mating together. The strap system allows for the present invention to adjust to fit various sizes of refrigerators.

A plurality of containers 32 are adapted for securement to the plurality of sections 12. The containers 32 each are defined by a closed forward face 36 and a closed rearward face 38. The closed rearward face having a pair of spacers 34 extending outwardly therefrom. The closed rearward face 38 has a pair of apertures 40 therethrough in alignment with the pair of linear rows of apertures 22.

A plurality of hooks 42 are provided with each having a vertically oriented interior portions 44 positioned inwardly of two of the apertures 22 of the pair of linear rows of the pair of sections. The hooks 42 each have an outer hooked portion 46 that engages the pair of apertures 40 of the containers 32.

The present invention consists of a plastic storage unit that would be slipped over a standard refrigerator 16 and secured with adjustable straps. The present invention features a series of storage containers 32 that would be positioned of the sides of the refrigerator 16 that could easily be moved or adjusted through the use of the hooks 42 and the apertures 22 of the planar sections 12. The present invention would be used to store a wide range of kitchen products, such as canned goods, cleaning supplies, snacks, paper towels, cookbooks, etc. The present invention would save storage space in a kitchen, and items would be easily accessible when needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage system for storing a wide array of kitchen products to save space in the kitchen comprising, in combination:

a refrigerator;

a pair of planar sections for securing to opposing sides of the refrigerator;

a strap system for adjustably securing the planar sections together for engaging the refrigerator; and a plurality of containers for securing to the pair of planar sections.

2. The storage system as set forth in claim 1 wherein each of the planar sections has a pair of linear rows of apertures therethrough disposed in a spaced relationship along a length and thereof, rear surfaces of the planar sections each having spacers disposed thereon.

3. The storage system as set forth in claim 2 wherein the strap system comprises a pair of male straps extending outwardly from upper ends of one of the planar sections and a pair of female straps extending outwardly from upper ends of the other of the planar sections, each of the straps having hook and loop patches disposed on free ends thereof.

4. The storage system as set forth in claim 3 wherein the male straps extend across the top wall of the refrigerator for adjustably coupling with the female straps.

5. The storage system as set forth in claim 2 and further including a plurality of hooks each having a vertically oriented interior portions positioned inwardly of two of the apertures of the pair of linear rows of the pair of sections, the hooks each having an outer hooked portion for engaging apertures of the containers.

6. The storage system as set forth in claim 5 wherein the containers each are defined by a closed forward face and a closed rearward face, the closed rearward face having a plurality of spacers extending outwardly therefrom, the closed rearward face having a pair of apertures therethrough in alignment with the pair of linear rows of apertures for receiving the hooks therethrough.

7. A storage system for storing a wide array of kitchen products to save space in the kitchen comprising, in combination:

a refrigerator;

a pair of planar sections for securing to opposing sides of the refrigerator, each of the planar sections having a pair of linear rows of apertures therethrough disposed in a spaced relationship along a length and thereof, rear surfaces of the planar sections each having spacers disposed thereon;

a strap system for adjustably securing the planar sections together for engaging the refrigerator, the strap system comprising a pair of straps extending outwardly from upper ends of each of the planar sections, each of the straps having hook and loop patches disposed on free ends thereof, the straps extending across a top wall of the refrigerator for mating together, each of the planar sections having a pair of slots extending therethrough towards the upper end thereof, the straps being inserted through the slots, each of the straps having a loop on a proximal end thereof, each of the loops receiving an elongate generally cylindrical rod therein, the rod having a length defined between opposite ends thereof, the length of each of the rods being longer than a length of each of the slots;

a plurality of containers for securing to the pair of sections, the containers each being defined by a closed forward face and a closed rearward face, the closed rearward face having a plurality of spacers extending outwardly therefrom, the closed rearward face having a pair of apertures therethrough in alignment with the pair of linear rows of apertures;

a plurality of hooks each having a vertically oriented interior portions positioned inwardly of two of the apertures of the pair of linear rows of the pair of sections, the hooks each having an outer hooked portion engaging the pair of apertures of the containers.

* * * * *